US006241241B1

(12) United States Patent
Fricke et al.

(10) Patent No.: US 6,241,241 B1
(45) Date of Patent: Jun. 5, 2001

(54) METHOD AND DEVICE FOR ELIMINATING RHYTHMIC REGISTER ERRORS IN SHEET-FED ROTARY PRINTING MACHINES

(75) Inventors: Andreas Fricke, Eberbach; Rudi Hofstetter, Östringen; Heiner Luxem, Wilhelmsfeld, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/244,834

(22) Filed: Feb. 4, 1999

(30) Foreign Application Priority Data

Feb. 4, 1998 (DE) ..... 198 04 272

(51) Int. Cl.[7] ..... B65H 9/04
(52) U.S. Cl. ..... 271/245; 271/277; 101/409
(58) Field of Search ..... 271/245, 246, 271/247, 277, 145; 101/246, 409, 410, 411, 412

(56) References Cited

U.S. PATENT DOCUMENTS 4,402,266 * 9/1983 Sugiyama ..... 101/409
4,825,762 * 5/1989 Fischer ..... 271/245
5,080,347 * 1/1992 Funada ..... 271/246
5,125,336 * 6/1992 Germann ..... 271/245
5,496,023 * 3/1996 Becker et al. ..... 271/245
5,749,572 * 5/1998 Fricke et al. ..... 101/409
5,761,998 * 6/1998 Fricke et al. ..... 271/245
5,862,757 * 1/1999 Hauck ..... 101/409

* cited by examiner

*Primary Examiner*—John M. Jillions
(74) *Attorney, Agent, or Firm*—Herbert L. Lerner; Laurence A. Greenberg; Werner H. Stemer

(57) ABSTRACT

A method for eliminating rhythmic register errors in sheet-fed rotary printing machines, the sheets therein being transported by an impression cylinder of double size having two gripper arrangements, includes bringing front lays, which have been provided for orienting the sheets at a feed table, out of an end position outside a conveying plane of the sheets and into a first orientation position on the feed table, then bringing the front lays back into the end position, and thereafter bringing the front lays into a second orientation position on the feed table; and a device for performing the method.

11 Claims, 2 Drawing Sheets

METHOD AND DEVICE FOR ELIMINATING RHYTHMIC REGISTER ERRORS IN SHEET-FED ROTARY PRINTING MACHINES

BACKGROUND OF THE INVENTION

Field of the Invention

The invention relates to a method and a device for eliminating rhythmic register errors in sheet-fed rotary printing machines.

In sheet-fed rotary printing machines with a transport drum of double the conventional printing-unit cylinder size, in particular an impression cylinder of double size, and, as a consequence thereof, having two gripper arrangements, the problem arises that an error in the unwinding of successive sheets in relation to the rubber blanket cylinder, and a consequent print offset occur due to manufacturing or assembly tolerances in the components of the impression cylinder. Two successive sheets, which are therefore transported alternately by different gripper arrangements, consequently have a circumferential offset in relation to one another. The result of this is that the sheets receive their print at a slightly offset location in a two-by-two rhythm. During a single run of a sheet through the printing machine, this small offset influences only the length of the print-free sheet edge, which is virtually of no significance.

A problem arises only when a print order is to have a second print run, for example when a four-color print is to be produced by a two-color machine.

In this case, then, in order to avoid the offset between the print image of the first run and that of the second run, it will be necessary for the impression cylinder gripper arrangement which grasped the sheet during the first print run also to transport the same sheet during the second print run.

It has been possible heretofore to satisfy this requirement only by executing a specimen proof print at the start of the second print run. The print result indicated whether the sequence of the sheets supplied was correct. If this was not so, it was possible for the pressman to correct the sequence by removing a sheet from the sheet pile or feed table. Moreover, after damaged sheets had been removed, this operation possibly had to be repeated during the processing of the order (for example, by stopping at the feeder due to multiple and oblique sheets, respectively, or overshooting), because the correct relationship was lost again due to the random withdrawal or extraction of an odd number of sheets. These measures, however, require a considerable amount of time, and an appreciable quantity of spoilage occurs.

The published German Patent Document DE 196 18 029 A1 can solve the problem described above by gripper arrangements on a sheet transfer cylinder, the gripper arrangements having adjustable closing times.

SUMMARY OF THE INVENTION

It is accordingly an object of the invention to provide a method and a device for eliminating rhythmic register errors in sheet-fed rotary printing machines which ensure that sheets, having been once printed, can be printed in-register, irrespective of the sequence thereof, during a second print run through a sheet-fed rotary printing machine.

With the foregoing and other objects in view, there is provided in accordance with one aspect of the invention, a method for eliminating rhythmic register errors in sheet-fed rotary printing machines, the sheets therein being transported by an impression cylinder of double size having two gripper arrangements, which comprises bringing front lays, which have been provided for orienting the sheets at a feed table, out of an end position outside a conveying plane of the sheets and into a first orientation position on the feed table, then bringing the front lays back into the end position, and thereafter bringing the front lays into a second orientation position on the feed table.

In accordance with another mode, the method of the invention includes pivoting the front lays.

In accordance with a further mode, the method of the invention includes transferring the sheets by a pregripper from the feed table to a gripper arrangement of a single-size supply drum.

In accordance with an added mode, the method of the invention includes setting the first orientation position in relation to a first gripper arrangement of the impression cylinder, and the second orientation position in relation to a second is gripper arrangement of the impression cylinder.

In accordance with another aspect of the invention, there is provided a device for eliminating rhythmic register errors in sheet-fed rotary printing machines, wherein sheets are transportable by an impression cylinder of double size having two gripper arrangements, comprising a cyclically driven front lay shaft having a front lay lever, the front lay lever having a stop face that is bringable into contact with a cyclically pivotable stop.

In accordance with a further feature of the invention, the stop face is bringable alternately into contact with a fixed stop and with the cyclically pivotable stop.

In accordance with an added feature of the invention, the front lay shaft is drivable in a single revolution, and the cyclically pivotable stop is drivable in a half revolution.

In accordance with an additional feature of the invention, the single-revolution drive is a first control cam, and the half-revolution drive is a second control cam.

In accordance with yet another feature of the invention, the first orientation position is settable independently of the second orientation position.

In accordance with yet a further feature of the invention, the front lay shaft is mounted in an adjustable lever, and a setting device is included for adjusting the front lay shaft in and opposite to a sheet transport direction.

In accordance with a concomitant feature of the invention, the pivotable stop has an adjustable eccentric, the eccentric being in rolling contact, via a roller lever and a control roller, with a control disk.

In the method according to the invention, it is advantageous that, in particular, the printed sheet to be transported is exactly oriented, as early as at the feed table, in relation to the gripper arrangement which subsequently transports it and which is located on the impression cylinder.

Because to each gripper arrangement on the double-size impression cylinder there is assigned a position of the front lays on the feed table, the pressman does not have to pay attention to the sequence of the printed sheets during the second print run. This avoids spoilage and affords time saving. The quality of the printed product is increased.

The device for performing the method according to the invention advantageously has, in addition to the front lay shaft driven in a single revolution, a control cam driven in a half revolution, for pivoting a stop into two end positions.

The front lay, which is pivotable back and forth, is thereby brought alternately into two different orientation positions on the feed table. Because the end positions can be set independently of one another, each front lay orientation position can be set exactly in relation to the corresponding gripper arrangement on the double-size impression cylinder.

Other features which are considered as characteristic for the invention are set forth in the appended claims.

Although the invention is illustrated and described herein as embodied in a method and device for eliminating rhythmic register errors in sheet-fed rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
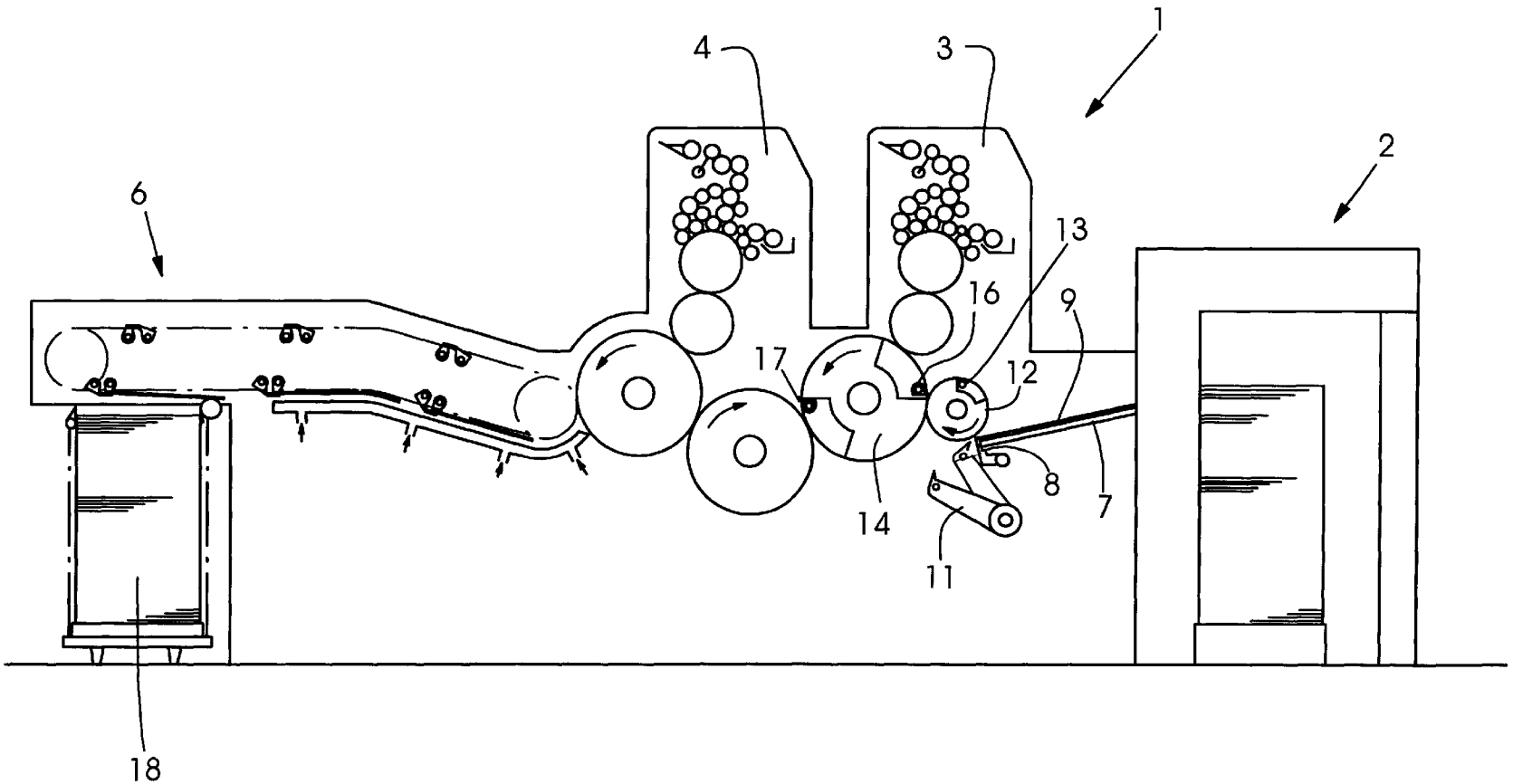
FIG. 1 is a diagrammatic side elevational view of a sheet-fed rotary printing machine incorporating the device according to the invention.

Referring now to the drawings and, first, particularly to FIG. 1 thereof, there is shown therein a sheet-fed rotary printing machine 1 having, amongst other features, a feeder 2, a plurality of printing units 3 and 4 and a delivery 6. A device for pivoting sheet-orienting elements, the so-called front lays 8, is provided at the end of a feed table 7 of the feeder 2. The sheets 9 are oriented in a conventional manner at the front lays 8, received by a pregripper 11 and transferred to a supply drum 12 having a single gripper arrangement 13. The sheet 9 is printed in the succeeding first printing unit 3 and is transferred to a second printing unit 4 by an impression cylinder 14 of double the conventional printing-unit cylinder size with the aid of gripper arrangements 16 and 17. After printing has taken place in the printing unit 4, the sheet 9 is deposited onto a sheet pile 18 by the delivery 6.

Figure 2:
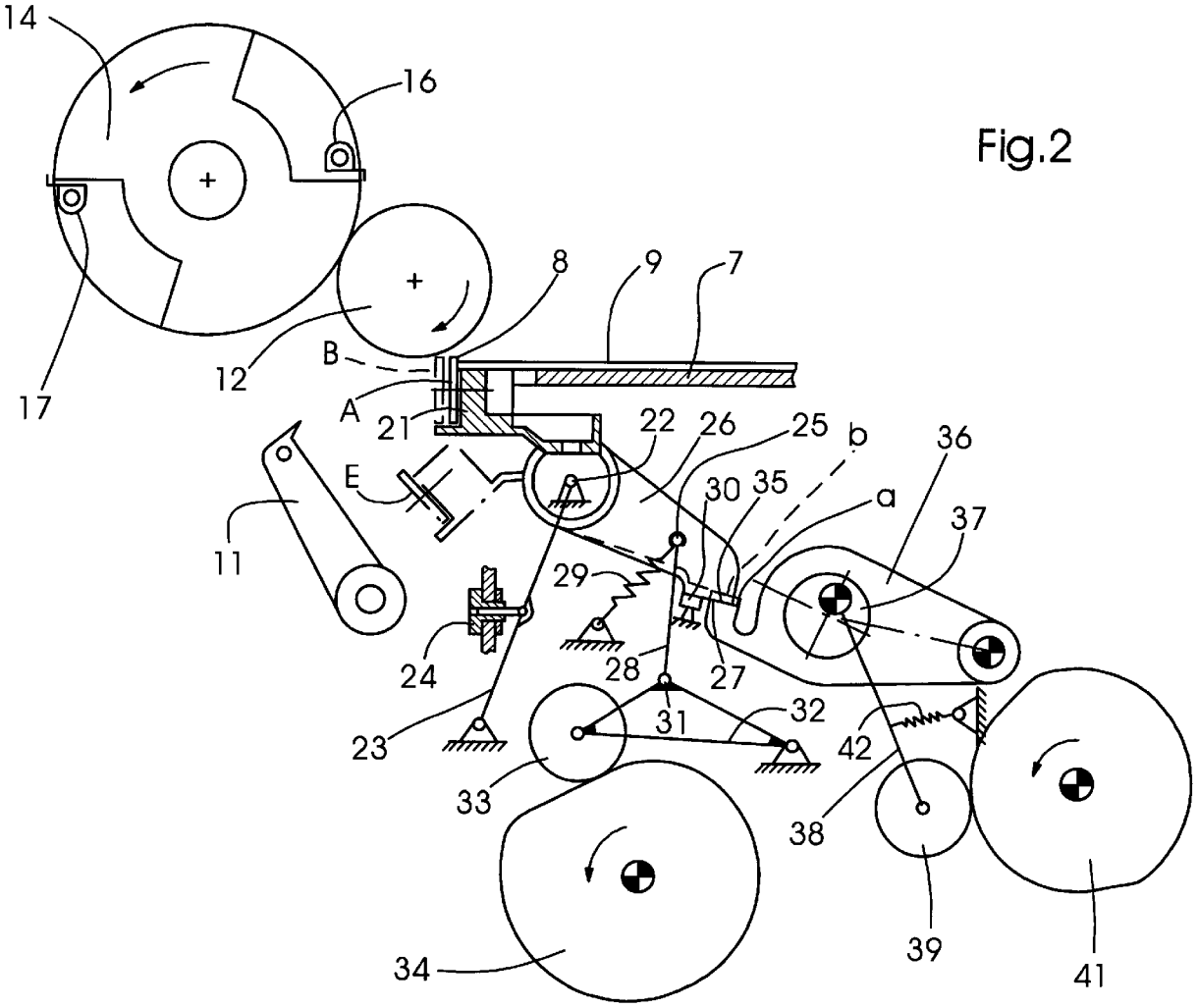
FIG. 2 is an enlarged fragmentary view of FIG. 1 diagrammatically showing the device according to the invention for front lay positioning.

As shown in FIG. 2, the front lays 8 are arranged transversely to the sheet transport direction at the end of the feed table 7 and, by a front lay carrier 21, are mounted so as to be jointly pivotable about a front lay shaft 22 arranged below the conveying plane. In this case, the front lays 8 are pivoted back and forth out of a position located outside the conveying plane into two different orientation positions on the feed table 7.

The front lay shaft 22 is mounted in a pivotable bearing lever 23 which is pivotable through small setting angles in or opposite to the sheet transport direction by a setscrew 24 for the purpose of setting a print-free margin. The front lay shaft 22 carries, fixedly in terms of rotation, a front lay lever 26 which has a stop face 27 at the distal end thereof. Provided on the front lay lever 26 is an articulation point 25, at which a link 28 is pivotably mounted. One end of a return spring 29 engages on the same articulation point 25, while the other end of the return spring being secured fixedly to the machine frame. The link 28 has, at the end thereof located opposite to the articulation point 25, a bearing point 31 for a roller lever 32. The latter is pivotably mounted at a first end on the machine frame and, at the second end thereof, carries a rotatably mounted control roller 33. The control roller 33 is in rolling contact with a control cam 34 driven in a single revolution in the work cycle of the sheet-fed rotary printing machine 1.

The stop face 27 of the front lay lever 26 is arranged so as to be capable, during the work cycle of the sheet-fed rotary printing machine 1, of being brought alternately into contact with a stop 30 fixed relative to the machine frame and with a stop face 35 formed on the stop lever 36. The stop lever 36 is mounted pivotally in the machine frame. It is articulated by an eccentric 37 which, in turn, is fixedly connected to a roller lever 38.

The roller lever 38 has, at an end thereof, a control roller 39 that is in rolling contact with a control cam 41 driven a half revolution or turn in the work cycle of the rotary printing machine 1 and possessing a detent region of pronounced height. A return spring 42, arranged with one end thereof on the roller lever 38 and with the other end thereof fixed to the machine frame, ensures contact between the control roller 39 and the control cam 41.

The device according to the invention operates as follows: by the single-revolution control cam 34, the front lays 8 are driven cyclically about the axis of the front lay shaft 22 and first pivoted out of the end position E below the conveying plane in the direction of the first orientation position A on the feed table 7. At the same time, the stop face 27 of the front lay lever 26 butts onto the stop 30 fixed to the machine frame. The control roller 33 lifts off from the control cam 34. A sheet 9 can be laid against the front lays 8 and oriented relative to the gripper arrangement 16. In this phase, the control roller 39 is located in the lower detent region of the control cam 41, with the result that the stop face 35 of the stop lever 36 is located under the stop 30 fixed to the machine frame and is therefore inactive. The front lays 8 remain at rest until the rising region of the control cam 34 comes into contact with the control roller 33 again.

The front lays 8 are thereby brought into the end position E, so that the oriented sheet can be transported into the first printing unit 3 by the pregripper 11.

This is followed by the front lays 8 being pivoted back into the orientation position B on the feed table 7. For this purpose, the stop face 35 has previously been positioned above the stop 30 fixed to the machine frame, as a result of the half-revolution rotation of the control cam 41, which is effected by the high detent region of the control cam 41. When the stop faces 35 and 27 butt onto one another, the front lays 8 are in the orientation position B. The sheet arriving next at the front lays 8 is therefore laid against these in the orientation position B which is assigned to the gripper arrangement 17. The device continues to work in this two-by-two cycle, so that the front lays 8 are pivoted between the positions E-A-E-B-E-A-E-B, and so forth.

The orientation position B is determined by the pivotable stop 35. The exact stop position between the stop face 27 of the front lay lever 26 and the stop face 35 of the stop lever 36 can be set by the pivotable eccentric 37 which is rotatable and lockable relative to the roller lever 38.

We claim:

1. A method for eliminating rhythmic register errors in sheet-fed rotary printing machines, the sheets therein being transported by an impression cylinder of double size having two gripper arrangements, which comprises bringing front lays, which have been provided for orienting the sheets at a feed table, out of an end position outside a conveying plane of the sheets and into a first orientation position on the feed table, then bringing the front lays back into the end position, and thereafter bringing the front lays into a second orientation position on the feed table.

2. The method according to claim 1, which includes pivoting the front lays.

3. The method according to claim 1, which includes transferring the sheets by a pregripper from the feed table to a gripper arrangement of a single-size supply drum.

4. The method according to claim 1, which includes setting the first orientation position in relation to a first gripper arrangement of the impression cylinder, and the second orientation position in relation to a second gripper arrangement of the impression cylinder.

5. A device for eliminating rhythmic register errors in sheet-fed rotary printing machines, wherein sheets are transportable by an impression cylinder of double size having two gripper arrangements, comprising:

a front lay shaft;

a front lay lever mounted to said front lay shaft; and at least one front lay mounted to said front lay shaft;

said front lay lever having a stop face that can be brought into contact with a cyclically pivotable stop for cyclically moving said at least one front lay.

6. The device according to claim 5, wherein said stop face is bringable alternately into contact with a fixed stop and with said cyclically pivotable stop.

7. The device according to claim 5, wherein said front lay shaft is drivable in a single revolution, and said cyclically pivotable stop is drivable in a half revolution.

8. The device according to claim 5, wherein said single-revolution drive is a first control cam, and said half-revolution drive is a second control cam.

9. The device according to claim 5, wherein said first orientation position is settable independently of said second orientation position.

10. The device according to claim 5, wherein said front lay shaft is mounted in an adjustable lever, and including a setting device for adjusting said front lay shaft in and opposite to a sheet transport direction.

11. The device according to claim 5, wherein said pivotable stop has an adjustable eccentric, said eccentric being in rolling contact, via a roller lever and a control roller, with a control cam.

* * * * *